US005722383A

United States Patent [19]

Tippmann, Sr. et al.

[11] Patent Number: 5,722,383

[45] Date of Patent: Mar. 3, 1998

[54] IMPEDER FOR A GUN FIRING MECHANISM WITH AMMUNITION FEEDER AND MODE SELECTOR

[75] Inventors: Dennis J. Tippmann, Sr., New Haven; Dennis J. Tippmann, Jr., Fort Wayne, both of Ind.

[73] Assignee: Tippmann Pneumatics, Inc., Fort Wayne, Ind.

[21] Appl. No.: 566,139

[22] Filed: Dec. 1, 1995

[51] Int. Cl.[6] ..... F41B 11/02; F41A 9/61

[52] U.S. Cl. ..... 124/76; 124/72; 124/48; 124/51.1; 221/24; 221/266

[58] Field of Search ..... 124/76, 74, 72, 124/70, 48, 49, 50, 51.1, 52, 53; 188/302, 303, 311, 314, 267, 224; 24/2; 89/190, 189, 181, 131, 33.17; 221/24, 263, 266

[56] References Cited

U.S. PATENT DOCUMENTS

| | | | |
|---|---|---|---|
| 905,401 | 12/1908 | Billmeyer | 221/266 |
| 1,743,576 | 1/1930 | Smith . | |
| 2,091,672 | 8/1937 | Cleerman | 89/189 |
| 2,590,981 | 4/1952 | Lippert et al. | 89/190 |
| 2,828,732 | 4/1958 | Horowitz et al. | 124/52 X |
| 2,873,650 | 2/1959 | Pinkerton, Jr. . | |
| 3,244,132 | 4/1966 | Leichner et al. . | |
| 3,318,191 | 5/1967 | Reed | 89/190 X |
| 3,384,269 | 5/1968 | Garrett | 221/266 |
| 3,473,434 | 10/1969 | Bridger | 89/190 X |
| 3,650,177 | 3/1972 | Hupp et al. . | |
| 3,724,325 | 4/1973 | Silsby . | |
| 3,807,379 | 4/1974 | Vodinh | 124/49 X |
| 3,855,988 | 12/1974 | Sweeton | 124/50 X |
| 3,878,827 | 4/1975 | Newgarden, Jr. | 124/51.1 X |
| 4,023,465 | 5/1977 | Inskip . | |
| 4,034,644 | 7/1977 | Hupp et al. | 89/33.17 |
| 4,116,192 | 9/1978 | Scott . | |
| 4,126,079 | 11/1978 | Perrine | 89/190 |
| 4,147,152 | 4/1979 | Fischer et al. | 124/76 |
| 4,207,857 | 6/1980 | Balka, Jr. | 124/50 X |
| 4,328,737 | 5/1982 | Nelson et al. | 42/25 X |
| 4,523,509 | 6/1985 | Thevis et al. . | |
| 4,616,622 | 10/1986 | Millman | 124/76 X |
| 4,819,609 | 4/1989 | Tippmann | 124/72 |
| 4,936,282 | 6/1990 | Dobbins et al. . | |
| 4,986,251 | 1/1991 | Lilley | 124/52 X |
| 5,097,985 | 3/1992 | Jones | 124/49 X |
| 5,280,778 | 1/1994 | Kotsiopoulos | 124/73 |
| 5,282,454 | 2/1994 | Bell et al. | 124/49 |
| 5,335,579 | 8/1994 | David . | |
| 5,349,939 | 9/1994 | Perrone | 124/76 |
| 5,383,442 | 1/1995 | Tippmann . | |
| 5,413,083 | 5/1995 | Jones . | |
| 5,456,153 | 10/1995 | Bentley et al. | 89/33.17 |
| 5,497,758 | 3/1996 | Dobbins et al. | 124/76 X |

*Primary Examiner*—Terry Lee Melius
*Assistant Examiner*—Thomas A. Beach
*Attorney, Agent, or Firm*—Barnes & Thornburg

[57] ABSTRACT

An ammunition feed mechanism for an automatic or semi-automatic weapon which includes a mechanism for retarding the cyclic feeding of ammunition into the chamber of the weapon. The mechanism for retarding the cyclic feeding of ammunition includes an impeder which engages the bolt of the weapon. The ammunition feed mechanism also includes a magazine having a ramped bottom which directs ammunition projectiles to an exit therein where the ammunition projectiles are fed into the chamber of the weapon. The magazine includes a plurality of curved projections in the bottom which define a plurality of spaces into which the ammunition projectiles are received. The plurality of curved projections also guide the ammunition projectiles through the exit.

33 Claims, 7 Drawing Sheets

IMPEDER FOR A GUN FIRING MECHANISM WITH AMMUNITION FEEDER AND MODE SELECTOR

BACKGROUND AND SUMMARY OF THE INVENTION

The present invention relates to guns. More particularly, the present invention relates to an apparatus for retarding movement of a cyclically reciprocating member of the gun firing mechanism during each reciprocating cycle of the member, an ammunition feed mechanism for feeding a projectile into a chamber of the gun at a same point during each reciprocating cycle of the member, and a mode selector switch for selecting a rate of fire of the gun.

Ammunition power feeds supply projectiles to a chamber of a gun for firing by a firing mechanism. Ammunition power feeds should be designed to correctly feed a projectile into the gun chamber for firing by the firing mechanism. Misfeeds, such as loading a projectile only partially into the gun chamber or loading a projectile in backwards, can cause the gun to "jam" and require the chamber to be cleared, which is time consuming. Such misfeeds may additionally damage the gun. Furthermore, such misfeeds may be dangerous, causing injury to an operator of the gun when struck by the projectile or causing injury to the operator by failing to operate when needed for protection.

Ammunition power feeds should also be designed to positively feed or force a projectile into the chamber each time the firing mechanism is actuated. This is particularly true for semi-automatic and fully-automatic guns where firing rate is important. Malfunctions of this type can significantly reduce the firing rate, effectiveness, and reliability of a gun. The design of an ammunition power feed should additionally be "simple" to decrease manufacturing costs and operational breakdown, as well as to increase reliability, ease of use, and ease of servicing.

Firing mechanism retarders are designed to reduce the speed of the firing mechanism used to fire projectiles from the gun. One application for these mechanisms is conversion of a gun from semi-automatic firing to fully-automatic firing. This conversion requires reduction in the speed of the firing mechanism during a portion or all of its reciprocating cycle to allow sufficient time for loading of projectiles. If firing mechanism speed is not reduced, gun malfunctions such as jamming, breaking, or misfiring can occur.

Firing mechanism retarders should be designed to ensure that movement of the firing mechanism is properly impeded each reciprocating cycle of the firing mechanism. For example, with those retarders that only reduce the speed of the firing mechanism for a portion of each reciprocating cycle, correct and reliable engagement and subsequent disengagement with the firing mechanism each reciprocating cycle is a design goal. Additionally, the design of a firing mechanism retarder should be "simple" to decrease manufacturing costs and operational breakdown, as well as to increase reliability, ease of use, and ease of servicing.

A firing mechanism retarder of the present invention directed to these above-described design goals includes an apparatus for retarding movement of a cyclically reciprocating member during each reciprocating cycle of the member. The apparatus includes an impeder, a reset, and a release. The impeder is engaged with the member during a first portion of the reciprocating cycle of the member. The impeder resists displacement of the member during the first portion of the cycle. The impeder is disengaged from the member during a second portion of the reciprocating cycle.

The reset is engaged with the member during a third portion of the reciprocating cycle of the member to position the impeder for engagement with the member during the first portion of the reciprocating cycle. The release disengages the impeder from the member during the second portion of the reciprocating cycle.

The impeder may be displaced along an axis of reciprocation of the member. The first and third portions of the reciprocating cycle may occur during movement of the member in a same direction. The member may be a bolt of a firing mechanism.

The impeder may include an impeder sear engaged with a surface of the member and a sear movement retarder impeding displacement of the impeder sear and the member during engagement between the impeder sear and the member. The impeder sear may include a cam-shaped surface and the release may interact with the cam-shaped surface of the impeder sear to disengage the impeder sear from the member. The cam-shaped surface of the impeder sear may include an edge that defines an opening and the release may include a pin disposed within the opening and interacting with the edge to lift the sear out of engagement with the member. The sear movement retarder may include a piston assembly coupled to the impeder sear. The piston assembly may include a piston displaced by the impeder sear during engagement between the impeder sear and the member.

The reset may include a reset sear and the sear movement retarder may include a piston assembly coupled to the impeder sear and the reset sear. In this embodiment, the piston assembly may include first and second pistons in fluid communication with one another, the first piston assembly being coupled to the impeder sear and the second piston assembly being coupled to the reset sear. The reset sear engages the member during the third portion of the reciprocating cycle, is displaced by the member, and positions the impeder sear for engagement with the member during the first portion of the reciprocating cycle.

The sear movement retarder may be resistive to compressive forces. In addition, the sear movement retarder may be resistive to tensile forces. The sear movement retarder may include a piston disposed within a housing that is at least partially filled with a fluid medium.

The sear movement retarder may include an adjuster for controlling the rate by which fluid displacement of the member is impeded.

The apparatus may additionally include an ammunition feed mechanism of the present invention directed to the above-described design goals. The ammunition feed mechanism may include a body having an exit and a projectile carrier mechanism having a plurality of spaces each of which receives a projectile of the ammunition. The projectile carrier mechanism forces one of the projectiles out of the exit each reciprocating cycle of the member.

Another embodiment of the ammunition feed mechanism is for an apparatus, such as a gun, including a chamber having a projectile entrance that cyclically opens and closes. This embodiment of the ammunition feed mechanism includes a magazine, an ammunition carrier, and an ammunition carrier advancing mechanism. The magazine has an exit and the ammunition carrier has a plurality of spaces each of which receives a projectile of ammunition. The ammunition carrier advancing mechanism actuates the ammunition carrier to positively force one projectile out of the exit each time the projectile entrance is open.

A bottom of the magazine may be formed to include a ramp directing projectiles to the exit of the magazine. The ammunition carrier may include a plurality of projections that define the spaces. These projections of the ammunition carrier may be curved for guiding each projectile through the exit and into the chamber. The ammunition carrier may include a wheel having a hub coupled to the ammunition carrier advancing mechanism. The projectiles of the ammunition carrier may radiate from the hub and curve from a proximate end of each projection to a distal end of each projection. The curving of the projections may be away from a direction of movement of the ammunition carrier.

The ammunition carrier advancing mechanism may include spring that releases stored energy to move the ammunition carrier. The ammunition carrier advancing mechanism may also include a crank for storing energy in the spring when the crank is moved in a first direction and at least one anti-reversing roller coupled to the crank that engages the magazine to help prevent the crank from moving in a second direction so that energy stored in the spring is used to move the ammunition carrier. In another embodiment, the ammunition carrier advancing mechanism includes a motor.

The exit of the magazine may be located at a bottom of the magazine and the magazine may be mounted to the apparatus so that ammunition in the magazine is gravity fed toward the bottom of the magazine during operation of the apparatus. Alternatively, a bottom of the magazine may be actuated in a direction of force applied by such means as a spring or compressed air to force projectiles into the spaces of the ammunition carrier.

An embodiment of a gun constructed in accordance with the preset invention includes a chamber, a cyclically reciprocating member, an ammunition feed mechanism, and a retarder. The chamber has a projectile entrance and the cyclically reciprocating member is used to fire projectiles from the gun. The ammunition carrier includes a magazine having an exit mounted adjacent the projectile entrance of the chamber. The ammunition feed mechanism also includes an ammunition carrier having a plurality of spaces each of which receives one projectile from the magazine. The projectile carrier positively feeds one projectile into the chamber via the exit and the projectile entrance at a same point during each reciprocating cycle of the member. The retarder includes an impeder engaged with the member during a first portion of the reciprocating cycle of the member to resist displacement of the member during the first portion of the reciprocating cycle of the member. The impeder is disengaged from the member during a second portion of the reciprocating cycle of the member.

The first portion of the reciprocating cycle may be prior to firing one projectile from the gun. At least a part of the second portion of the reciprocating cycle of the member may be after firing one of the projectiles from the gun.

The gun may additionally include structure for selecting a rate of fire of the gun. The selecting structure may include a mode selector switch positionable in one of a plurality of positions. These positions may include a locked position and an automatic firing position. The positions may also include a semi-automatic firing position.

The mode selector switch may include a pin having one or more surfaces for interacting with a firing mechanism of the gun, in one or more of the mode selector switch positions, to control displacement of the firing mechanism. The firing mechanism may include a trigger.

The selecting structure may also include structure for releasably securing the selector switch in each mode selector switch position. The selecting structure may include a plurality of recessed portions formed in a body of the selector switch and a detent disposable in one of the recessed portions in each selector switch position.

Other objects, advantages and novel features of the present invention will become apparent from the following detailed description of the invention when considered in conjunction with the accompanying drawings.

DETAILED DESCRIPTION OF THE DRAWINGS

Figures 1, 2, 10, 11:
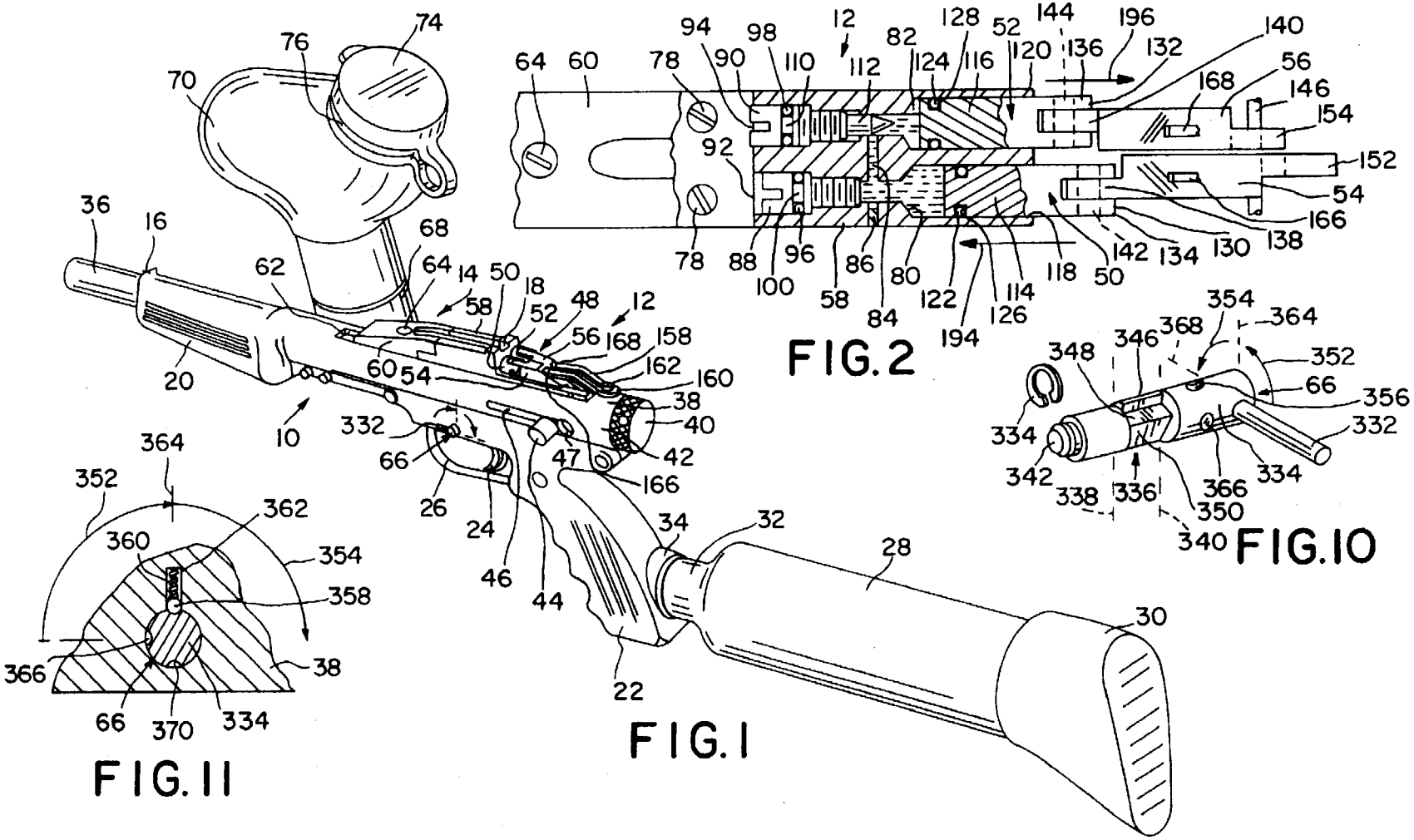
FIG. 1 is a perspective view of a gun equipped with an embodiment of a retarder mechanism and an embodiment of an automatic feed mechanism constructed in accordance with the present invention.
FIG. 2 is a top, partial cross-sectional view of the retarder mechanism shown in FIG. 1.
FIG. 10 is a perspective view of a mode selector switch constructed in accordance with the present invention.
FIG. 11 is a cross-sectional view of the mode selector switch shown in FIG. 10 installed in the gun of FIG. 1.

FIG. 1 shows a perspective view of a gun 10 equipped with an embodiment of a retarder mechanism 12 constructed in accordance with the present invention and an embodiment of an automatic feed mechanism 14 also constructed in accordance with the present invention. Gun 10 includes a front sight 16 and a rear-notched sight 18 which are used together to aim gun 10. Gun 10 additionally includes a front hand grip or forestock 20 and a pistol grip 22 both of which are used to hold gun 10 in a firing position. Gun 10 additionally includes a firing mechanism, such as trigger 24, used to manually fire projectiles from gun 10. Trigger 24 is partially surrounded by a trigger guard 26. Gun 10 additionally includes a shoulder stock 28 and a buttplate 30. A $CO_2$ or other compressed gas canister forms shoulder stock 28 and is used as a propellant to fire projectiles from gun 10 and also operate the firing mechanism thereof, as discussed more fully below. As can be seen in FIG. 1, canister 28 includes a neck portion 32 that is received in a socket portion 34 of pistol grip 22 by such means as a threaded engagement between neck 32 and socket 34.

Gun 10 further includes a barrel 36 from which projectiles are fired and a frame 38 to which components of gun 10, such as retarder mechanism 12 and automatic feed mechanism 14, are attached. A cap 40 is received within an end 42 of frame 38 by such means as threaded engagement between cap 40 and end 42 of frame 38. Cap 40 helps seal a chamber of gun 10. In other embodiments of gun 10, a compressed gas canister may be received in end 42 of frame 38 instead of at socket portion 34.

Gun 10 additionally includes a handle 44 connected to a cyclically reciprocating member (e.g., a bolt) of gun 10 used to fire projectiles therefrom. Handle 44 cyclically reciprocates within slot 46 formed in frame 38 of gun 10. Slot 46 includes an end 47 that receives handle 44 when the reciprocating member of gun 10 is in a "cocked" or ready position for firing a projectile.

Retarder mechanism 12 includes an impeder 48 that engages a cyclically reciprocating member of a firing mechanism during a portion of its reciprocating cycle, as discussed more fully below. Impeder 48 includes a pair of piston assemblies 50 and 52 that are connected to sears 54 and 56 that engage the cyclically reciprocating member as discussed more fully below. Piston assemblies 50 and 52 are housed within a block 58 that is connected to frame 38 of gun 10. As can be seen in FIG. 1, rear-notched sight 18 is integrally formed as a part of block 58. However, other embodiments of retarder mechanism 12 may not include an integrally formed rear-notched sight 18. That is, rear-notched sight 18 is separately connected to block 58 or another portion of gun 10.

A cover 60 is secured over part of an opening 62 in which retarder mechanism 12 is disposed via a fastener 64.

Gun 10 may additionally include a mode selector switch 66 movable between safe, semi-automatic, and fully automatic settings, as described in U.S. Pat. No. 4,819,609. Mode selector switch 66 may operate in the manner described in U.S. Pat. No. 4,819,609.

Automatic feed mechanism 14 includes a magazine 68 to which a hopper 70 is coupled. Hopper 70 includes an opening (not shown) that is removably covered by a cover 74 that fits over and engages a lip 76 defining the opening. Projectiles, such as paint balls, are loaded into hopper 70 via this opening. These projectiles travel from hopper 70 into magazine 68 of automatic feed mechanism 14 where they are positively fed or forced into a chamber (not shown in FIG. 1) of gun 10 as more fully discussed below.

A top, partial cross-sectional view of retarder mechanism 12 is shown in FIG. 2. The above-described piston assemblies 50 and 52, sears 54 and 56, and block 58 are shown, as is a part of cover 60. Block 58 is shown as being secured to frame 38 via a pair of fasteners 78. As can be seen in FIG. 2, block 58 is formed to include a pair of chambers 80 and 82 that are fluidly coupled together via a channel or port 84. Channel or port 84 is substantially sealed via a plug or seal 86 to help prevent escape of fluid, such as air, within chambers 80 and 82 and channel or port 84. Threaded fasteners 88 and 90 seal respective ends 92 and 94 of respective chambers 80 and 82. Each threaded fastener 88 and 90 is fitted with a seal, such as O-ring seals 96 and 98, that are seated about neck portions 100 and 110 of fasteners 88 and 90. A needle or adjuster 112 may be formed on fastener 90 and used to adjustable control the rate of fluid flow between chambers 80 and 82 by blocking part or all of channel or port 84.

Each piston assembly 50 and 52 also includes a piston 114 and 116 disposed within respective chambers 80 and 82 via respective ends 118 and 120. Seals, such as O-ring seals 122 and 124, are seated about respective grooves 126 and 128 of respective pistons 114 and 116 to substantially seal ends 118 and 120 of respective chambers 80 and 82.

Ends 130 and 132 of respective pistons 114 and 116 are formed to include forked portions 134 and 136. Forked portions 134 and 136 receive respective reduced portions 138 and 140 of sears 54 and 56 as shown. Forked portion 134 and 136 and reduced portions 138 and 140 are each formed to include openings therein that receive pins 142 and 144 to connect sears 54 and 56 to respective pistons 114 and 116.

Figure 3:
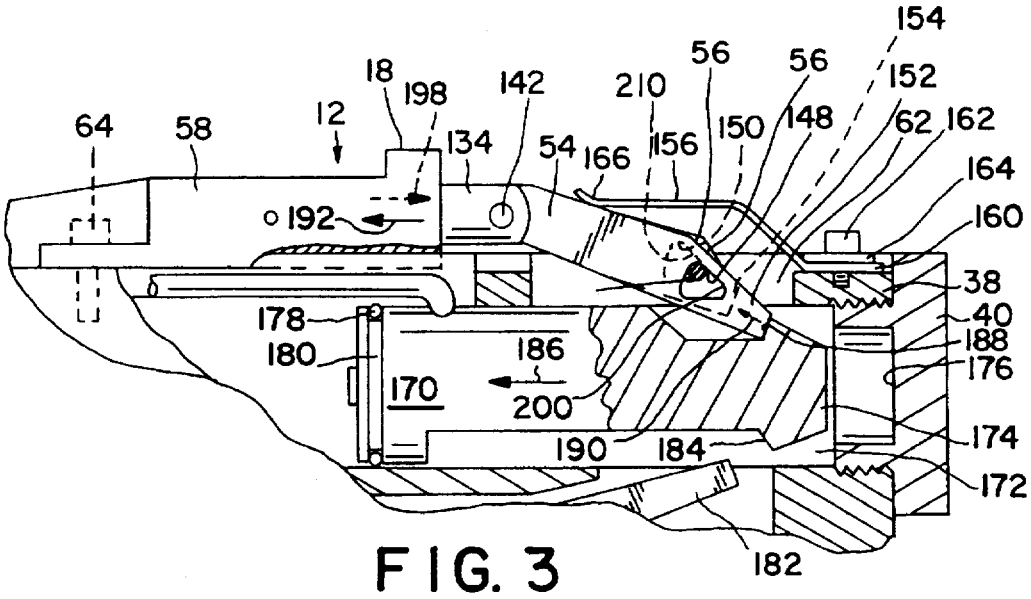
FIG. 3 is a side view of a stage of operation of the retarder mechanism shown in FIG. 1.
Figure 4:
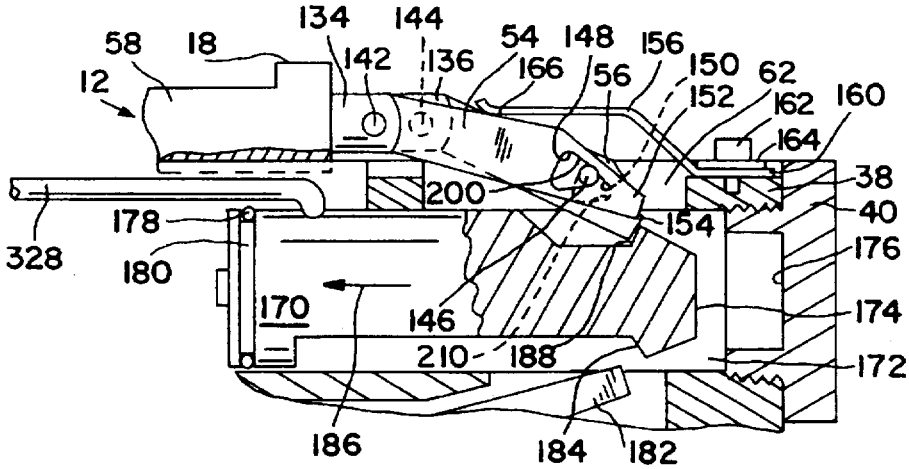
FIG. 4 is a side view of the retarder mechanism shown in FIG. 3 during a different stage of operation of the retarder mechanism.
Figure 5:
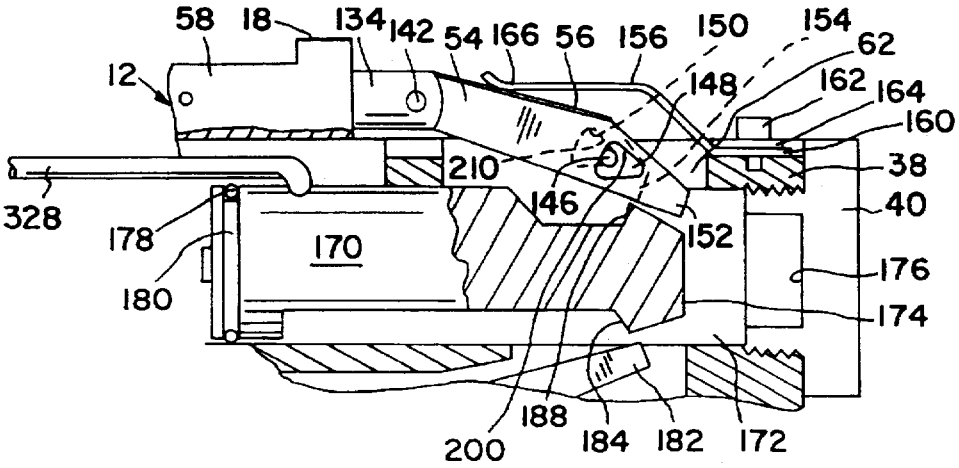
FIG. 5 is a side view of the retarder mechanism shown in FIG. 3 during a different stage of operation of the retarder mechanism.

Retarder mechanism 12 additionally includes a release 146, that may be a pin, as shown in FIG. 2, disposed within openings 148 and 150 formed in respective sears 54 and 56 as shown in FIGS. 3–5. Release 146 helps disengage sears 54 and 56 from the cyclically reciprocating member of gun 10 used to fire projectiles therefrom as more fully discussed below.

Sears 54 and 56 include respective members 152 and 154 that engage the cyclically reciprocating member as more fully discussed below. As can be seen in FIG. 2, member 152 is slightly longer than member 154.

Retarder mechanism 12 additionally includes springs 156 and 158 (see FIG. 1) that are connected together end 160 which is attached to a portion of frame 38 of gun 10 via fastener 162 and washer 164 (see FIGS. 3–5). Ends 166 and 168 are respectively engaged with sears 54 and 56 to resiliently bias them in a direction toward cyclically reciprocating member 170, as shown in FIGS. 3–5.

FIGS. 3–5 illustrate different stages of operation of retarder mechanism 12. Cyclically reciprocating member 170 is shown disposed within an open section 172 of gun 10 defined by frame 38. Cap 40 is shown as being threadably secured to frame 38 adjacent the point of connection of springs 156 and 158. Although not shown, an actuator is used to impart cyclically reciprocating motion to member 170. This actuator may include a spring disposed between end 174 of member 170 and, for example, inside portion 176 of cap 40. An example of such an actuator mechanism is shown in U.S. Pat. No. 4,819,609. A seal, such as O-ring seal 178, is seated in groove or notch 180 of member 170 to substantially seal open portion 172.

A firing mechanism sear 182 engages a notch or shoulder portion 184 of member 170 to hold member 170 in place against movement caused by the urging of the actuator adjacent end 174, as discussed above. Sear 182 is moved out of engagement with notch or shoulder 184 upon actuation of trigger 24. In the embodiment illustrated, trigger 24 is manually pulled rearwardly toward grip 22 to pivot or move sear 182 out of engagement with notch or shoulder 184.

With sear 182 out of engagement with notch 184, member 170 moves forwardly under the urging of the actuator (not shown) toward barrel 36, as generally indicated by arrow 186, until member 152 engages notch or shoulder 188 of member 170, as shown in FIG. 3. Engagement between member 152 and notch or shoulder 188 causes sear 54 and piston 114 to move forwardly, being axially displaced along with member 170, as generally indicated by arrows 190 and 192 in FIG. 3 and arrow 194 in FIG. 2. Movement of piston 114 within chamber 80 displaces fluid medium therein. Fluid within chamber 80 is displaced through channel or port 84 into chamber 82 at a rate controlled by such factors as the size of channel or port 84 and chamber 82, as well as the depth of insertion of needle 112. Displacement of fluid into chamber 82 moves piston 116 and sear 56 in a direction generally opposite movement of piston assembly 52 and sear 54, as generally indicated by arrow 196 in FIG. 2 and arrow 198 in FIG. 3. The amount of displacement of piston assembly 52 and sear 56 is proportional to the displacement of piston assembly 50 and sear 54. In one or more embodiments of retarder mechanism 12, displacement of piston assembly 52 and sear 56 may be directly proportional to displacement of piston assembly 50 and sear 54. However, in other embodiments of retarder mechanism 12, displacement of piston assembly 52 and sear 56 may be more or less than that of piston assembly 50 and sear 54.

The engagement between member 152 and notch or shoulder 188 impedes movement of member 170 thereby reducing the firing rate of gun 10. The rate at which the firing rate of gun 10 is reduced is dependent upon one or more factors such as the size of piston chambers 80 and 82, the size of channel or port 84, the depth of insertion of needle 112 into chamber 82, the fluid medium disposed within chambers 80 and 82, and the shape of pistons 114 and 116.

Sear 54 is engaged with member 170 and axially displaced thereby until disengaged therefrom by release 146 as shown in FIG. 4. Edge 200, which defines opening 148, interacts with release 146 to lift or disengage member 152 from notch or shoulder 188 of member 170. As can be seen in FIGS. 3 and 4, the portion of edge 200 that interacts with release 146 is angled with respect to the direction of axial displacement of member 170, generally indicated by arrow 186, so that this angled surface cammingly engages release 146 to lift or disengage member 152 from notch or shoulder 188.

As shown in FIG. 3, member 154 is initially disengaged from notch or shoulder 188 as a result of a portion of edge 210, that defines opening 150, cammingly engaging release 146 to lift member 154 out of engagement with notch or shoulder 184. As can be seen in FIGS. 3–5, the portion of edge 210 that engages release 146 is also generally angled with respect to the direction of movement of member 170, generally indicated by arrow 186. The amount of angling of edge portion 210 is shown as being greater than the amount of angling of edge portion 200 in FIGS. 3–5. However, it is to be understood that other embodiments of retarder mechanism 12 of the present invention may angle edge portions 200 and 210 differently. For example, edge portion 200 may be angled to a greater amount then edge portion 210. Alternatively, edge portions 200 and 210 may be angled approximately the same. Some factors, not necessary the only ones, which determine this amount of angling include such things as the length of members 152 and 154 and the relative positioning of release 146 within openings 148 and 150.

Piston assembly 50 and sear 54 act as a reset when engaged with member 170 during a portion of its reciprocating cycle to position member 154 of sear 56 for engagement with notch 188 of member 170. The engagement between member 154 and member 170 resists displacement of member 170 in a direction generally indicated by arrow 186. When member 154 is engaged with notch 188, member 170 displaces fluid out of chamber 82 and into chamber 80 via channel or port 84. As discussed above, the rate at which fluid is displaced is controlled by a variety of factors such as the depth of insertion of needle 112 into chamber 82. The impeding of movement of member 170 reduces the firing rate of projectiles from gun 10 as discussed above.

Eventually, member 170 displaces sear 56 and member 154 thereof to the position shown in FIG. 5. At this point, member 154 of sear 56 is lifted up and disengaged from notch 188 of member 170 by camming engagement between edge portion 210 of opening 150 and release 146 as discussed above in connection with edge portion 200 and release 146. Subsequent to disengagement of member 154 from notch 188, member 170 is free to travel, unimpeded by retarder mechanism 12, for the remainder of its forward movement and rearward movement back to the position shown in FIGS. 3 upon completion of one reciprocating cycle. At this point, member 170 is either stopped by engagement between sear 182 and notch or shoulder 184 or, if trigger 24 is still actuated, until engagement again between member 152 and notch or shoulder 188 which has been moved back into position for this engagement as a result of the displacement of sear 56 and piston assembly 52.

Ends 166 and 168 of respective springs of 156 and 158 bias respective sears 54 and 56 downwardly, in a direction generally towards member 170, facilitate engagement therewith and proper camming action between release 146 and edge portions 200 and 210 of respective openings 148 and 150.

The embodiment of retarder mechanism 12 disclosed in FIGS. 1–5 utilizes two piston assemblies and sears. As discussed above, one sear and piston assembly engages the cyclically reciprocating member and is displaced thereby to reset the other piston assembly and sear in a position for engagement with the firing member to further impede its rate of displacement. The second piston assembly and sear reduce the rate of travel of the firing member and are displaced thereby to reposition the reset piston assembly and sear for reengagement with the cyclically reciprocating member on its next cycle. It is to be understood, however, that other embodiments of retarder mechanism 12 may utilize a different structure, such as a single piston assembly, and a single sear, from gun 10. One factor controlling whether a single piston assembly and sear can be used is the rate of cyclical reciprocation of member 170. For guns having higher rates of cyclical reciprocation, the dual disclosed assembly may work more effectively and help better insure impeding engagement during a portion of the cyclical reciprocation of member 170. For such faster guns, a single sear may not drop downwardly under the urging of a spring quickly enough to reengage a shoulder or notch of the member subsequent to being disengaged therefrom by a release. It is to also be understood that impeding mechanisms other than piston assemblies may be used in other embodiments of retarder mechanism 12. For example, one or more piston assemblies of retarder mechanism 12 may be replaced by spring assemblies or assemblies including elastomeric members that are resistive to compressive and/or tensile forces.

Figure 6:
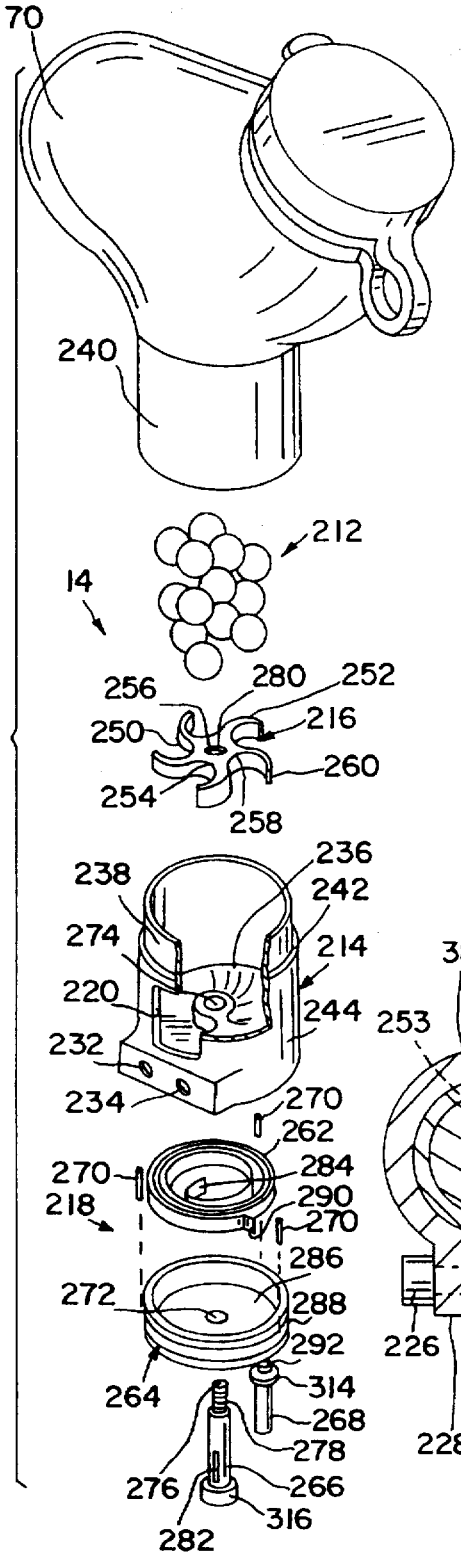
FIG. 6 is an exploded perspective view of an embodiment of an automatic feed mechanism constructed in accordance with the present invention.

An exploded perspective view of an embodiment of automatic feed mechanism 14 of FIG. 1 is shown FIG. 6.

The above-described hopper 70 is also shown. Also shown are a plurality of projectiles 212, in the form of paint balls, that are fired from barrel 36 of gun 10.

Automatic feed mechanism 14 includes a magazine 214, an ammunition carrier 216, and an ammunition carrier advancing mechanism 218. Magazine 214 includes an exit 220 that is mounted to frame 38 of gun 10 adjacent an entrance 222 of chamber 224 of gun 10 via a plurality of fasteners 226 that are disposed through members 228 and 230 of frame 38 and openings 232 and 234 of magazine 214, as shown in FIGS. 6 and 7.

Magazine 214 additionally includes a ramped bottom surface 236. Ramped bottom surface 236 helps direct projectiles 212 toward exit 220 and into chamber 224 via entrance 222. As can be seen in FIG. 7, ramped bottom surface 236 is angled so that center 213 of projectile 212D is above bottom edge 253 of projection or arm 252A and center 213 of projectile 212A is below bottom edge 253 of projection or arm 252B.

Figure 7:
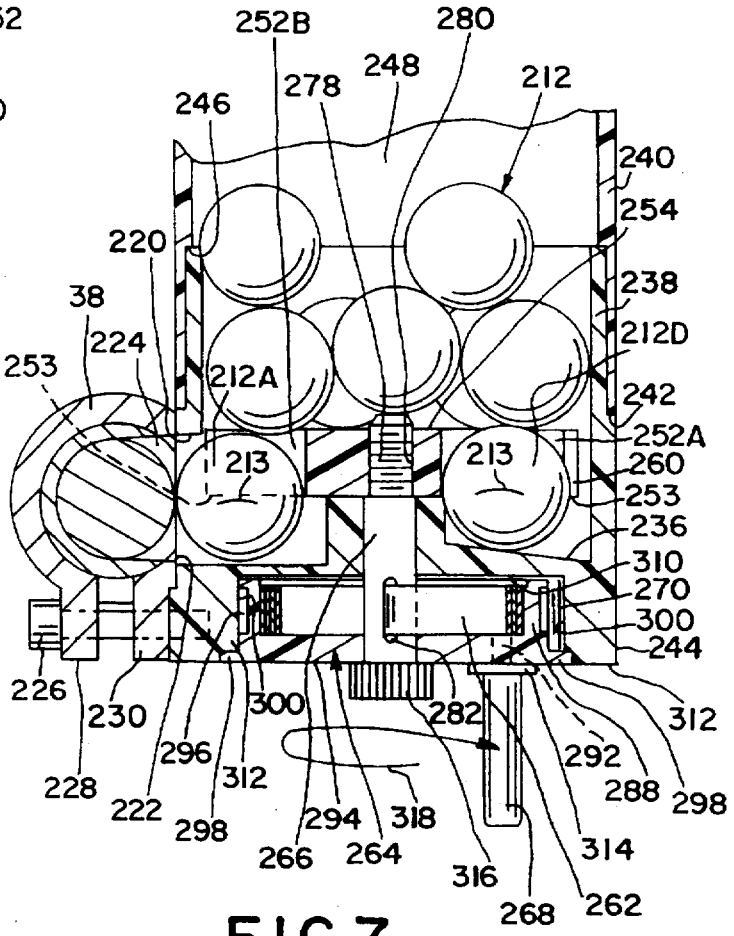
FIG. 7 is an assembled, cross-sectional side view of the automatic feed mechanism shown in FIG. 6.

Magazine 214 is further formed to include an upstanding portion 238 that is received within an opening 248 of hopper 70, defined by depending portion 240, to couple hopper 70 to ammunition feed mechanism 14 as shown in FIGS. 1 and 7. The depth of insertion of upstanding portion 238 into opening 248 is limited by a shoulder 242 formed on body 244 of magazine 214 which is engaged by depending portion 240 as shown in FIGS. 6 and 7. Depending portion 240 may also be formed to include a shoulder 246 engaged by upstanding portion 238 as an alternative or additional means for limiting the depth of insertion of portion 238 within opening 248 as shown in FIG. 7.

Figure 8:
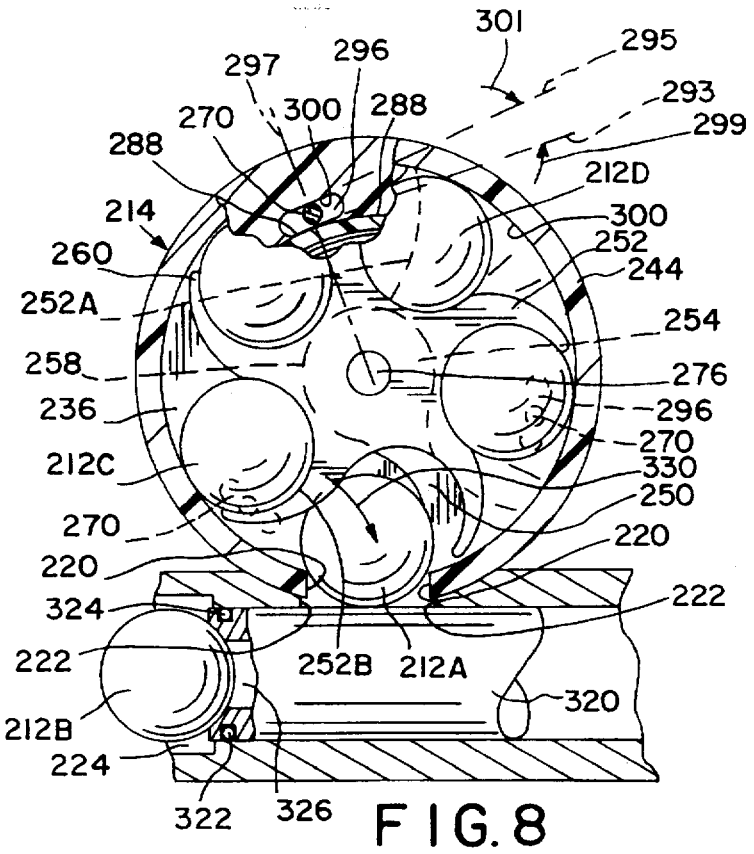
FIG. 8 is a top, cross-sectional view of the automatic feed shown in FIG. 6 illustrating operation of the automatic feed mechanism.
Figure 9:
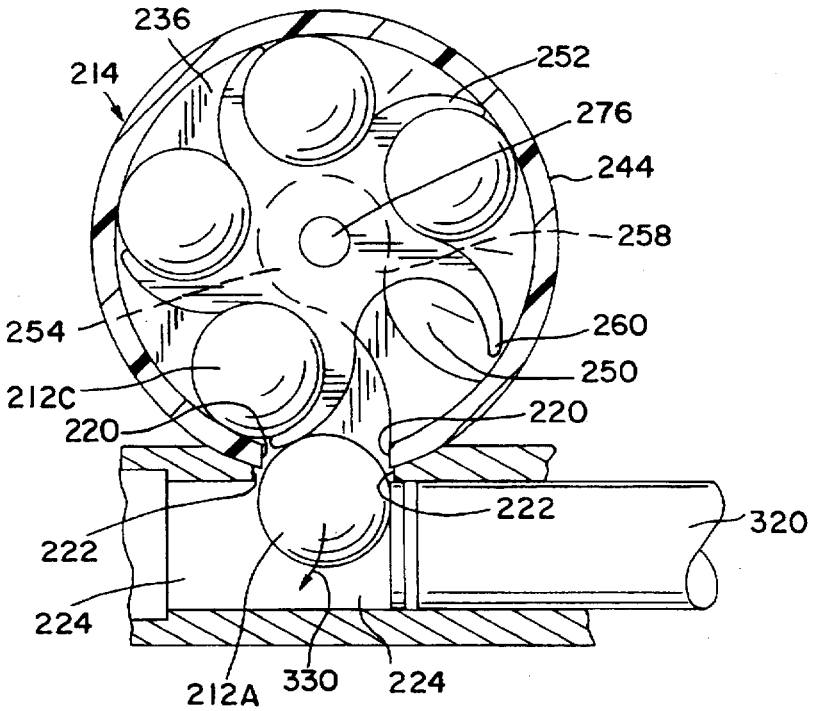
FIG. 9 is a top, cross-sectional view of the automatic feed mechanism shown in FIG. 8 during a different stage of operation of the automatic feed mechanism.

Ammunition carrier 216 includes a plurality of spaces 250 defined by a plurality of radiating projections or arms 252. Ammunition carrier 216 includes a hub 254, to which radiating projections or arms 252 are either attached or integrally formed, and an opening 256. As can be seen in FIGS. 6, 8, and 9, projections or arms 252 are curved. This curving helps direct or guide projectiles 212 out of exit 220 and into chamber 224 via entrance 222. As can also be seen in FIGS. 6, 8, and 9, projections or arms 252 are curved from a proximate end 258 to a distal end 260.

Ammunition carrier advancing mechanism 218 includes a spring 262, a plate 264, an axle 266, a pin 268, and one or more anti-reversing rollers 270. Axle 266 is disposed through opening 272 in plate 264 and opening 274 in magazine 214. End 276 of axle 266 is also disposed within opening 256 and includes a plurality of threads 278 that threadably engage wall 280 that defines opening 256 to secure ammunition carrier 216 to axle 266. Axle 266 also includes a slot 282 that receives an end 284 of spring 262 therein. Spring 262 is disposed within a recess 286 of plate 264 defined by upstanding wall 288. End 290 of spring 262 is disposed within a slot (not shown) formed in plate 264 or against a projecting rib (not shown) formed on upstanding wall portion 288. An end 292 of pin 268 is disposed within an opening (not shown) formed on bottom 294 of plate 264. One or more anti-reversing rollers 270 are positioned in recesses 296 formed in upstanding wall portion 288 of plate 264 so that anti-reversing rollers 270 are disposed between a lip 298 of plate 264 and a wall 300 of magazine 214 that defines recess 310 into which plate 264 is disposed when axle 266 is coupled to hub 254 of ammunition carrier 216. Shoulders 312 formed on magazine 214 engage lip 298 of plate 264 to control the depth of insertion of plate 264 within recess 310.

A washer 314 may be formed on pin 268 to control the depth of insertion of end 292 within the opening formed in bottom 294 of plate 264. Axle 266 may include a head 316 thereon to limit the depth of insertion of axle 266 within openings 272 and 274.

Energy is stored within spring 262 of ammunition carrier advancing mechanism 218 by manually actuating pin 268 thereof to turn mechanism 218 in a direction generally indicated by arrow 318. Energy stored within spring 262 is used to turn ammunition carrier 216 as discussed more fully below.

Anti-reversing rollers 270 engage wall 300 of magazine 214 and upstanding wall 288 of plate 264 to help prevent uncoiling of spring 262 while, at the same time, allowing energy to be stored therein by rotating pin 268 in a counterclockwise direction indicated by arrow 318, as discussed above. This is accomplished by angling each recess or slot 296 a predetermined number of degrees, as generally indicated by lines 293, 295, and 297, and arrows 299 and 301. This angling causes each anti-reversing roller 270 to move to the right when plate 264 is turned in a counterclockwise direction and to the left, wedging against walls 288 and 300, if plate 264 attempts to move in a clockwise direction under the urging of spring 262. This wedging locks plate 264 against such clockwise movement. In one or more embodiments of ammunition feed mechanism 14, the predetermined number of degrees is approximately between six and seven degrees.

Although ammunition carrier advancing mechanism 218 is shown as being driven by a spring 262, it is to be understood that other embodiments of ammunition carrier advancing mechanism 218 are possible. For example, ammunition carrier advancing mechanism 218 may include a motor as a source for energy rather than spring 262.

As shown in FIGS. 8 and 9, the firing mechanism of gun 10 includes an additional cyclically reciprocating member 320 that axially moves within chamber 224 of gun 10. Cyclically reciprocating member 320 cyclically opens and closes chamber entrance 222 as shown in FIG. 8 where entrance 222 is closed by member 320 to prevent a projectile 212A from entering and FIG. 9 where entrance 222 is open so that projectile 212A can be positively fed or forced into chamber 224. Member 320 includes a groove 322 on which a seal, such as O-ring seal 324, is seated to line to substantially seal chamber 224 so that projectiles 212 may be fired pneumatically therefrom via pneumatic fluid traveling opening 326 in member 320.

As can be seen in FIG. 8, a projectile 212 is disposed within each space 250 between a pair of radiating projections or arms 252. Spaces 250 are sized so that only a single projectile 212 is disposed therein at any given time to prevent misfeeds such as multiple projectiles 212 from being positively fed or forced into chamber 224 via exit 220 and entrance 222.

In the embodiment of automatic feed mechanism 14 shown, projectiles 212 fall into spaces 250 under the influence of gravity. However, it is to be understood that other means may be used to dispose a projectile 212 within each space 250 of ammunition carrier 216. For example, automatic feed mechanism 14 may be mounted in an upside down position (i.e., rotated 180 degrees with respect to the position of mechanism 14 shown in FIG. 1). In this embodiment, bottom surface 236 may be urged upwardly toward gun 10 by means such as a spring or compressed air so that a projectile 212 is disposed within each of spaces 250 of ammunition carrier 216.

Member 312 is coupled to member 170 by a rigid member, such as a rod 328 shown in FIGS. 3–5 so that cyclical reciprocating motion of member 170 causes cyclical reciprocating motion of member 320. As discussed above, FIG. 8 shows chamber entrance 222 closed by member 320 so that projectile 212A in magazine 214 is prevented from entering chamber 224. Another projectile 212B is adjacent member 320 for pneumatic firing. Upon firing of projectile 212B from chamber 224, member 170 is driven rearwardly toward cap 40, by pneumatic fluid or other means, which causes member 320 to move sufficiently rearwardly to open chamber entrance 222. Once open, a new projectile 212A is positively fed or forced into chamber 224, as generally indicated by arrow 330, upon rotation of ammunition carrier 216 in a counterclockwise direction. Arrow 330 may indicate a spinning of projectile 212A, caused by center 213 being below bottom edge 253 of projection or arm 252B, as discussed above. Projectile 212C is stopped from leaving exit 220 and entering chamber 224 via entrance 222 initially by the presence of projectile 212A and subsequently by member 320 when it resumes the position shown in FIG. 8. Advancement of ammunition carrier 216 in a counterclockwise direction is halted until projectile 212A is fired from chamber 224 and member 320 clears entrance 222 as shown in FIG. 9. In this way, ammunition carrier 216 helps insure that only a single projectile 212 is loaded in chamber 224 during each reciprocating cycle of members 170 and 320 of the firing mechanism of gun 10. Additionally, ammunition carrier 216 and ammunition carrier advancing mechanism 218 are designed to advance any number of spaces 250, if one or more of such spaces lack a projectile 212 disposed therein, until a space 250 having a projectile 212 therein is presented to exit 220 and entrance 222 and positively fed or forced into chamber 224. In this way, ammunition feed mechanism 14 helps ensure that a projectile is always available for firing during the firing stroke of the firing mechanism, regardless of the rate of firing, should at least one projectile be within hopper 70.

A perspective view of a mode selector switch 66 constructed in accordance with the present invention is shown in FIG. 10. As can be seen, mode selector switch 66 includes a lever 332 coupled to a body 334. Body 334 is formed to include a firing mechanism engagement portion 336 located between lines 338 and 340 in FIG. 10. Body 334 is also formed to include a reduced end 342 that receives a lock washer 334. Body 334 is disposed in a portion of frame 38 of gun 10 and secured thereto via placement of lock washer 344 on reduced end 342.

As can be seen in FIG. 10, firing mechanism engagement portion 336 includes a plurality of surfaces 346, 348, and 350. Surfaces 346, 348, and 350 are selectively positionable adjacent a portion of trigger 24, as discussed more fully below, to control the rate of firing of projectiles from gun 10. Surfaces 346, 348, and 350 are selectively positionable via movement of lever 332 in the directions generally indicated by arrows 352 and 354 in FIG. 10.

Mode selector switch 66 is releasably held in the position shown in FIG. 10 via engagement between recessed portion 356 and detent or ball 358 urged into recessed portion 356 under the influence of spring 360 disposed within cavity 362 of frame 38, as shown in FIG. 11. Lever 332 may be moved along the direction of arrow 352 to position 364 as shown in FIGS. 10 and 11. In position 364, surface 348 of firing mechanism engagement portion 336 engages trigger 24, as discussed more fully below. Mode selector switch 66 is held in position 364 via engagement between detent 358 and recessed portion 366 formed in body 334. When in position 364, lever 332 may be moved back to the position shown in FIG. 10 in a direction generally opposite that of arrow 352 shown in FIG. 10. When in position 364, lever 332 may also be moved in the direction generally indicated by arrow 354 in FIGS. 10 and 11 to position 368. In position 368, detent 358 engages recessed portion 370, shown in FIG. 11, to releasably secure mode selector switch 66 in position 368. When in position 368, lever 332 may be returned to either position 364 or that shown in FIG. 10 by movement of lever 332 in a direction generally opposite that of arrow 354 and arrow 352.

Figure 12:
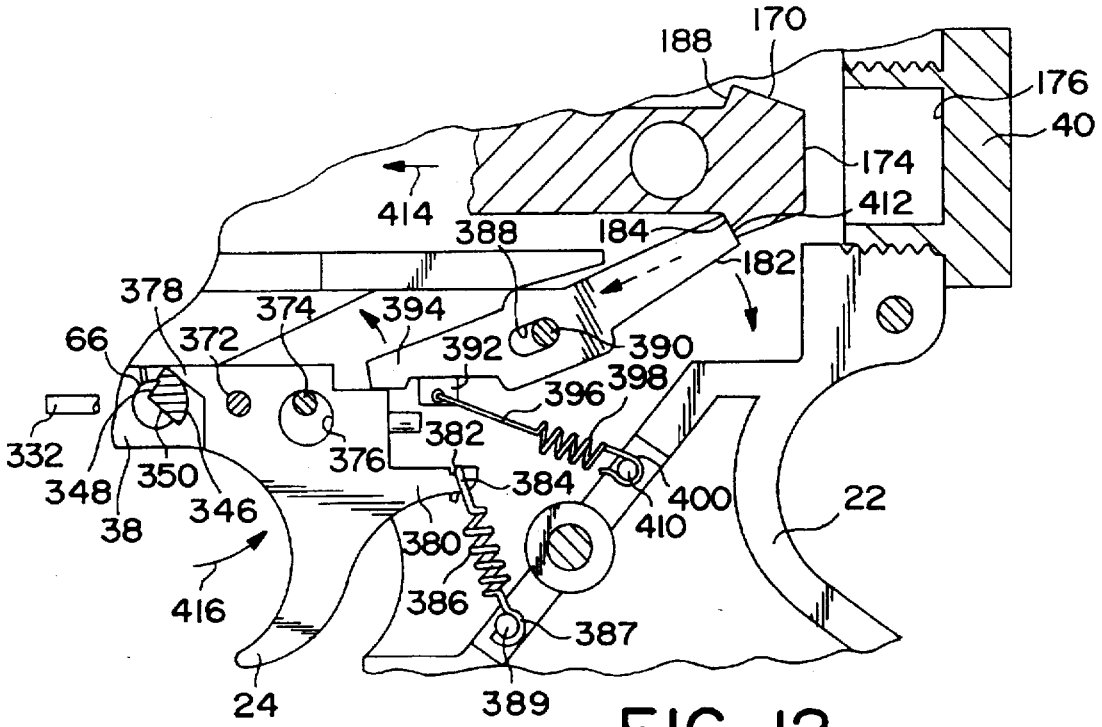
FIG. 12 is a cross-sectional view of the gun of FIG. 1 showing the mode selector switch positioned so that the gun is locked.

FIG. 12 is a cross-sectional view through a portion of gun 10 illustrating mode selector switch 66 in a locked position preventing firing of projectiles from gun 10. Components of gun 10 visible in FIG. 12 include trigger 24, mode selector switch 66, cyclically reciprocating firing member 170, and firing mechanism sear 182. Trigger 24 is pivotally secured to frame 38 of gun 10 via pin 372 and pin 374, which is disposed within opening 376 formed in trigger 24. Trigger 24 is formed to include an end 378 that engages a portion of mode selector switch 66, as more fully discussed below. Trigger 24 is also formed to include an extending member 380 having a notch 382 formed therein that receives an end 384 of a spring 386. An opposing end 387 of spring 386 attaches to pin 389 of frame 38.

As can be seen in FIG. 12, firing mechanism sear 182 includes a longitudinal or elongated hole 388 in which a pivot pin 390 is disposed. Pivot pin 390 is free to translate in hole 388, as more fully discussed below. A spring attachment member 392 is located near an end 394 of firing mechanism sear 182. An end 396 of spring 398 is disposed within an opening in spring attachment member 392. An opposing end 400 of spring 398 is attached to pin 410 of frame 38. As can be seen in FIG. 12, spring 386 urges trigger 24 into the position shown in FIG. 12 and spring 398 urges firing mechanism sear 182 into the position shown in FIG. 12 so that notch 184 of reciprocating member 170 engages end 412 of sear 182. In this position, member 170 is prevented from moving forward in a direction generally indicated by arrow 414 and firing a projectile 212.

As discussed above, mode selector switch 66 includes a firing mechanism engagement portion 336 formed to include a plurality of surfaces 346, 348, and 350. Surface 346 of firing mechanism engagement portion 336 is shown as engaging end 378 of trigger 24 in FIG. 12. In this position, gun 10 is prevented from firing a projectile because a force directed generally along arrow 416 in FIG. 12 will not displace trigger 24 to remove end 412 of firing mechanism sear 182 from notch 184 of member 170.

Figure 13:
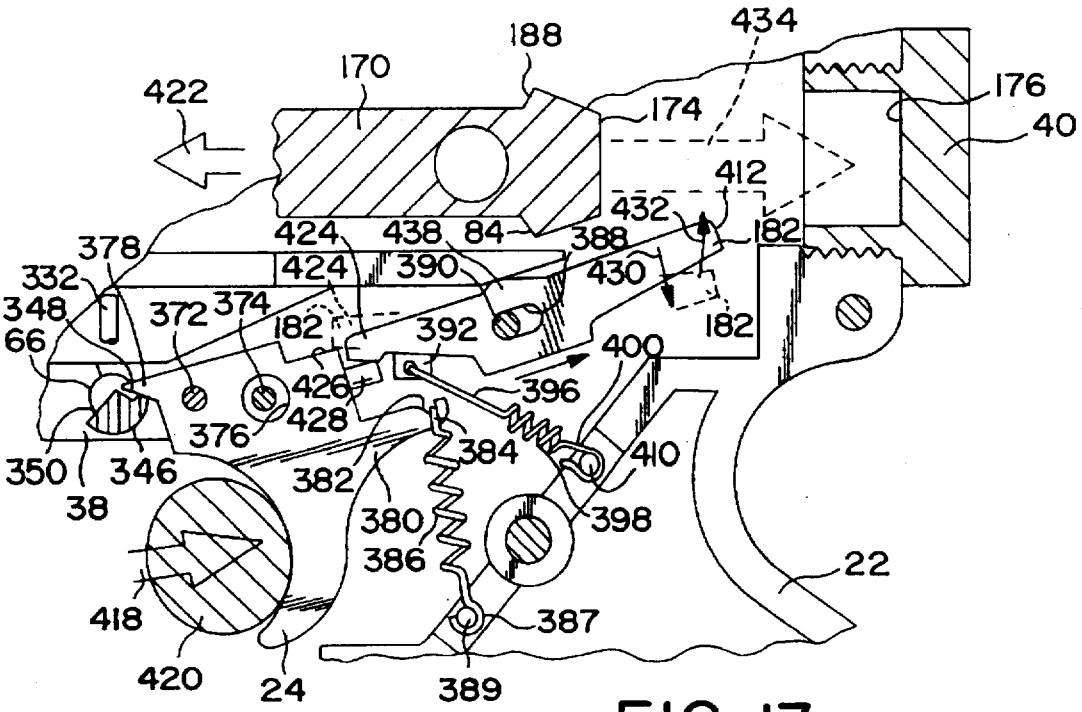
FIG. 13 is a cross-sectional view, like that shown in FIG. 12, with the mode selector switch in a semi-automatic position so that a projectile may be fired from the gun each time the firing mechanism is actuated.
Figure 14:
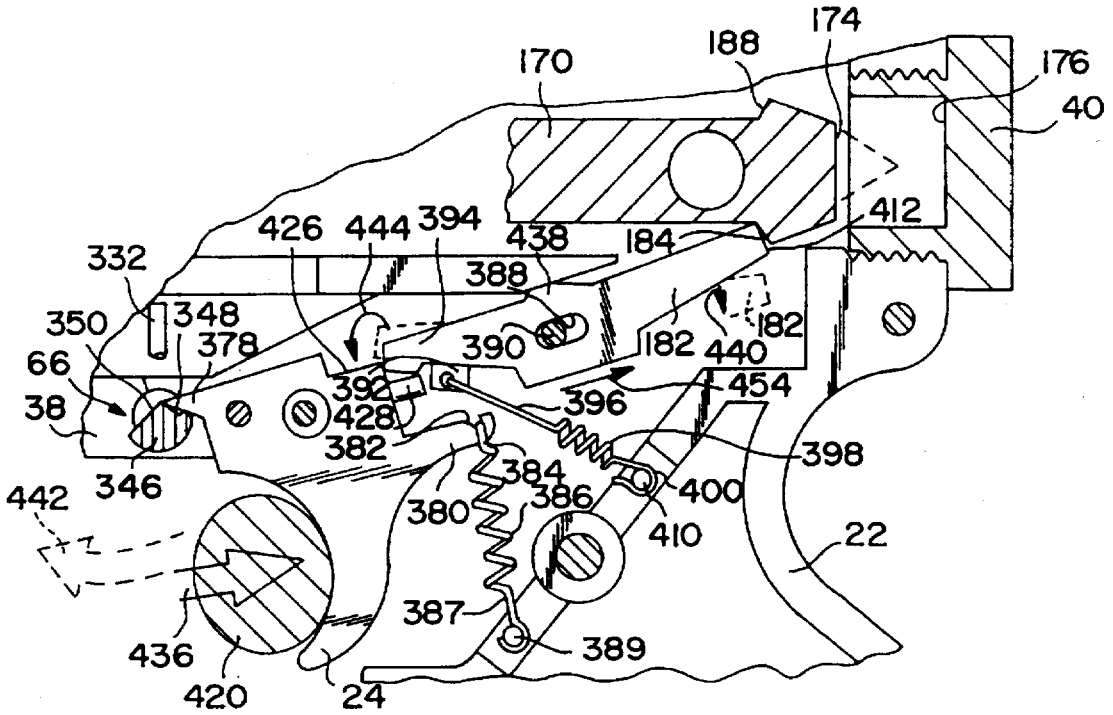
FIG. 14 is a cross-sectional view, like that shown in FIG. 13, showing the mode selector switch in the semi-automatic position after a projectile has been fired from the gun but before the firing mechanism has been reset.
Figure 15:
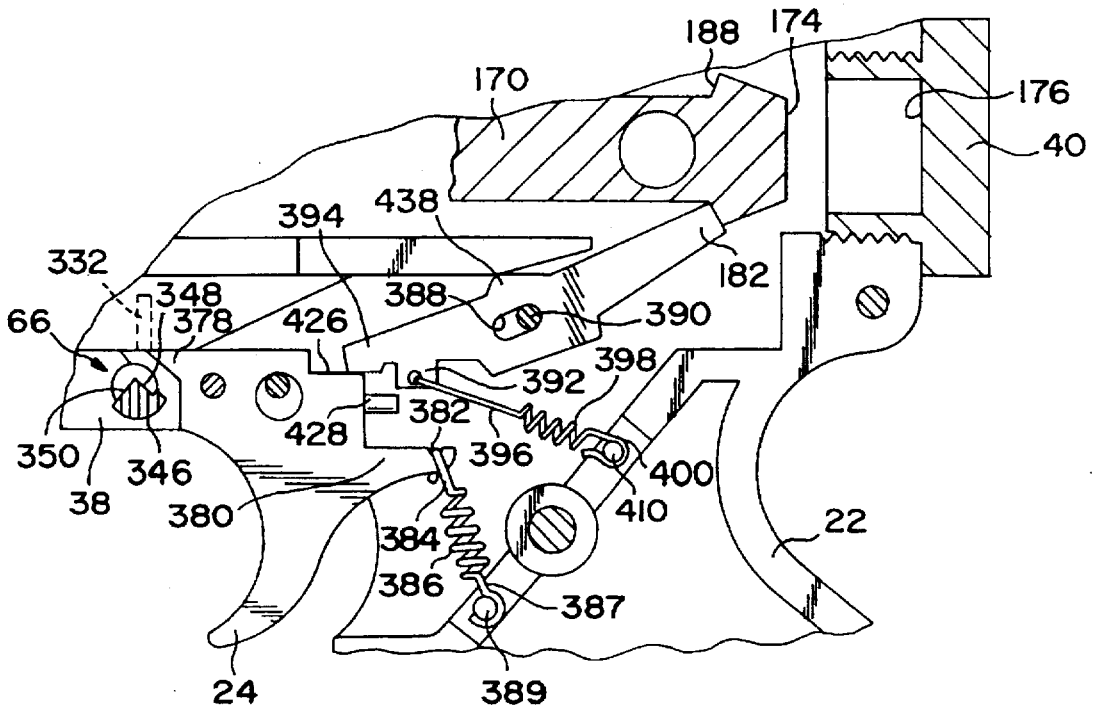
FIG. 15 is a cross-sectional view, like that shown in FIG. 14, showing the mode selector switch in the semi-automatic position after a projectile has been fired from the gun and after the firing mechanism has been reset so another projectile may be fired.

Operation of gun 10 in a semi-automatic mode is illustrated in FIGS. 13–15. In this mode, surface 348 of firing mechanism engagement portion 336 engages end 378 of trigger 24 to limit firing of projectiles from gun 10 to one projectile each time trigger 24 is actuated. Trigger 24 is displaced to the position shown in FIG. 13 upon application of a forced generally directed along large arrow 418 by such means as a finger 420. This displacement of trigger 24 initially moves sear 182 to the position generally indicated by dashed lines in FIG. 13. Sear 182 moves to this position by pivoting about raised portion 438 of sear 182. This allows firing member 170 to move forward in the direction generally indicated by large arrow 422 to fire a projectile 212 from gun 10. End 424 of sear 182 eventually clears ledge 426 of trigger 24 and comes to rest on extended portion 428 of trigger 24 to assume the position shown by solid lines in FIG. 13. Movement of sear 182 from an initial position engaging member 170 to the position shown by dashed lines is indicated by arrow 430. Movement from this position to the position wherein end 424 of sear 182 engages extended portion 428 of trigger 24 is generally indicated by arrow 432 in FIG. 13. As can be seen in FIG. 13, spring 386 is in tension as a result of movement of trigger 24 to the position shown and spring 398 is pulling end 424 of sear 182 against extended portion 428.

As discussed above, after moving a predetermined distance in the direction generally indicated by arrow 422, cyclically reciprocating member 170 returns in the direction generally indicated by large dashed arrow 434 in FIG. 13 to the position shown in FIG. 14 where end 412 of sear 182 engages notch 184 of member 170. End 412 of sear 182 is pulled against notch 184 of member 170 by spring 398, as generally indicated by arrow 454. Sear 182 is free to move in this manner by pin 390 translating in hole 388. Gun 10 cannot be fired again upon application of a force in a direction generally indicated by arrow 436, by means such as finger 420, because sear 182 will not pivot downwardly about raised portion 438 thereof in a direction generally indicated by arrow 440 to release member 170 to fire another projectile. Such movement is blocked by engagement between end 378 of trigger 24 and surface 348 of mode selector switch 66. In order to again fire a projectile, trigger 24 must be released so that spring 386 can exert a force thereon to move trigger 24 in a direction generally indicated by dashed arrow 442 in FIG. 13 so that trigger 24 assumes the position shown in FIG. 15. Movement of trigger 24 in a direction generally indicated by arrow 442 moves end 394 of sear 182 onto ledge 426 of trigger 24 as generally indicated by arrow 444 in FIG. 14 and also shown in FIG. 15. Repositioning of end 394 of sear 182 on ledge 426 of trigger 24 causes pin 390 to translate within hole 388 from the position shown in FIG. 14 to that shown in FIG. 15 under a force provided by member 170. Another projectile may be fired from gun 10 by again actuating or moving trigger 24 in the direction of arrow 418 shown in FIG. 13.

Figure 16:
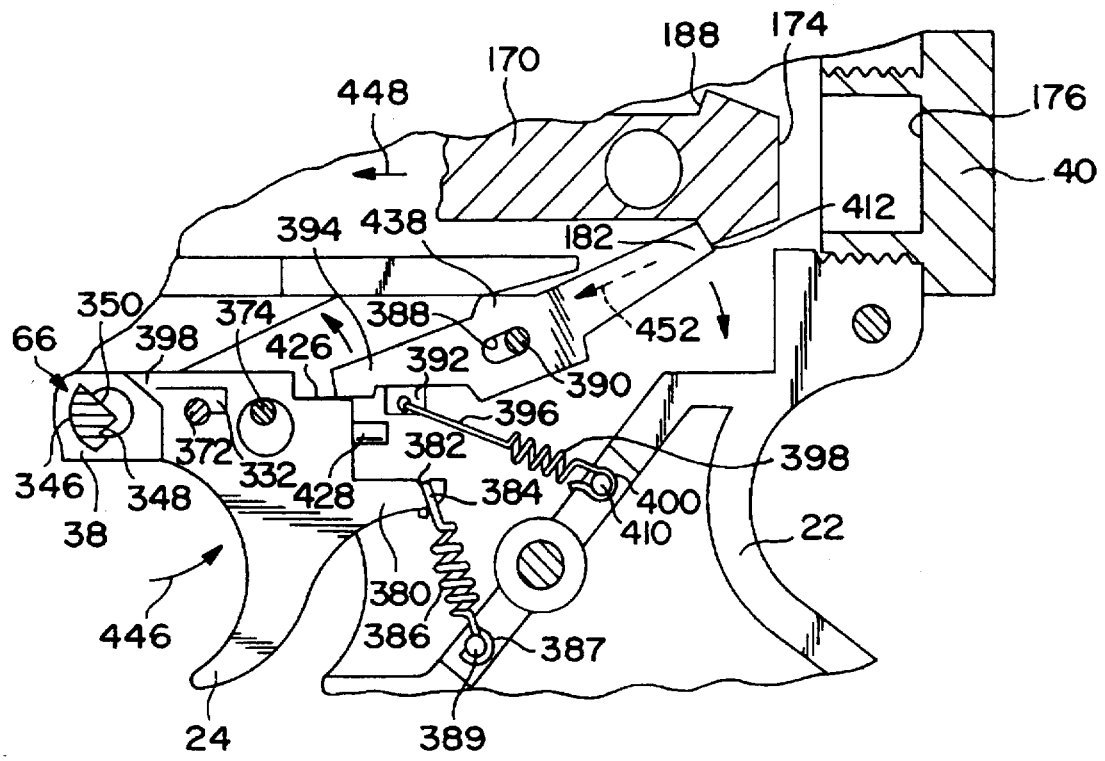
FIG. 16 is a cross-sectional view, like that shown in FIG. 13, illustrating the mode selector switch in the fully automatic position so that projectiles may be continuously fired from the gun.
Figure 17:
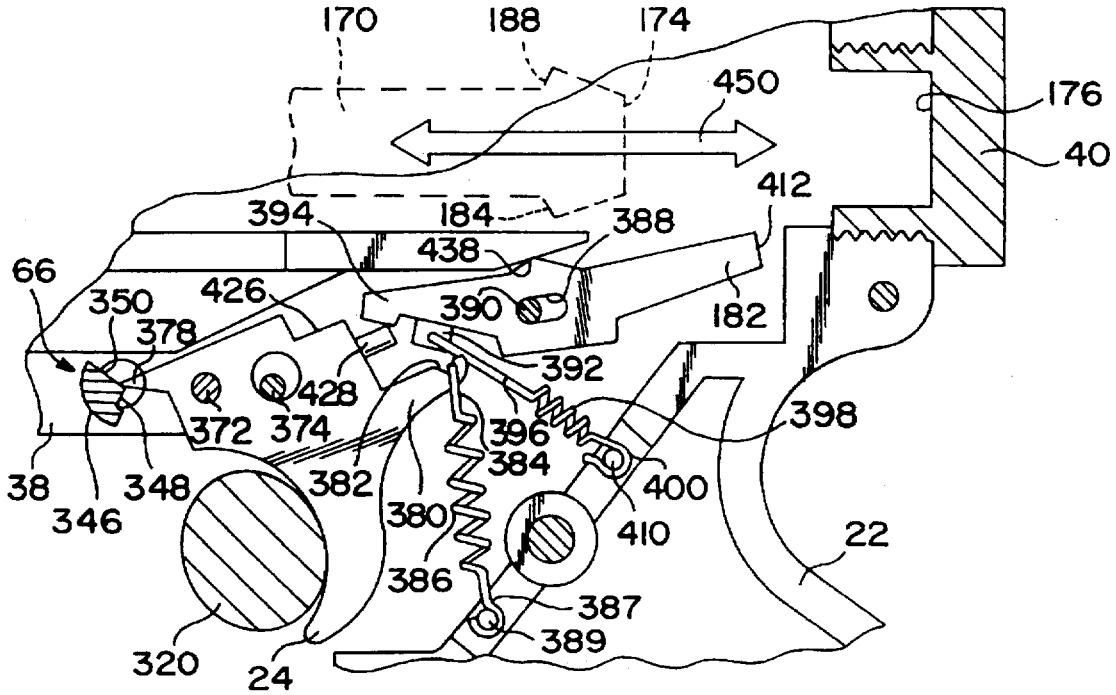
FIG. 17 is a cross-sectional view, like that shown in FIG. 16, illustrating the mode selector switch in the fully automatic mode and the firing mechanism actuated for continuous firing of projectiles from the gun.

Mode selector switch 66 may also be moved to a position that allows for automatic firing of projectiles from gun 10. This position of mode selector switch 66 is illustrated in FIGS. 16 and 17. In this position of mode selector switch 66, trigger 24 may be actuated by a force, generally indicated by arrow 446, again by means such as finger 420. Such movement of trigger 24 releases end 412 of sear 182 from notch or shoulder 184 of member 170 allowing for automatic firing of projectiles from gun 10 as member 170 reciprocates forward and backward in directions generally indicated by arrows 448 in FIG. 16 and large double headed arrow 450 in FIG. 17. During movement of trigger 24 in the direction generally indicated by arrow 446, end 378 thereof eventually contacts surface 350 of mode selector switch 66 to limit further movement of trigger 24. End 412 of sear 182 is prevented from reengaging shoulder or notch 184 of member 170 after a single full reciprocating cycle because extended portion 428 engages end 394 of sear 182 to pivot it about raised portion 438 a sufficient amount to clear the path of cyclically reciprocating member 170 as shown in FIG. 17. As can be seen from FIGS. 16 and. 17, pin 390 translates within hole 388 as indicated by arrow 452 in FIG. 16 to remove sear 182 from the path of cyclically reciprocating member 170. Upon release of trigger 24, spring 386 will move trigger 24 to the position shown in FIG. 16 so the end 394 moves onto ledge 426 and sear 182 reengages notch 184 of cyclically reciprocating member 170 to prevent further firing of projectiles from gun 10.

Although embodiments of the present invention have been shown and described for use with paint ball projectiles, it is to be understood that the present invention may find application for other types of projectiles as well. For example, a retarder mechanism constructed in accordance with the present invention may be used to impede cyclical reciprocatory motion of a member used to fire bullets or shells. Additionally, an automatic feed mechanism constructed in accordance with the present invention may be used to positively feed those bullets or shells to a firing chamber.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed:

1. An apparatus for retarding movement of a cyclically reciprocating member during each reciprocating cycle of the member, comprising:

an impeder engaged with the member during a first portion of the reciprocating cycle of the member, the impeder resisting displacement of the member during the first portion of the cycle, and disengaged from the member during a second portion of the reciprocating cycle, said impeder being displaced along an axis of the reciprocation member;

a reset engaged with the member during a third portion of the reciprocating cycle of the member to position the impeder for engagement with the member during the first portion of the reciprocating cycle; and a release for disengaging the impeder from the member during the second portion of the reciprocating cycle.

2. The apparatus of claim 1, wherein the first and third portions of the reciprocating cycle occur during movement of the member in a same direction.

3. The apparatus of claim 1, wherein the member is a bolt of a firing mechanism.

4. The apparatus of claim 1, further comprising an ammunition feed mechanism including a body having an exit and a projectile carrier mechanism having a plurality of spaces each of which receives a projectile, the projectile carrier mechanism forcing one of the projectiles out of the exit each reciprocating cycle of the member.

5. The apparatus of claim 1, wherein the impeder includes an impeder sear engaged with a surface of the member and a sear movement retarder impeding displacement of the impeder sear and the member during engagement between the impeder sear and the member.

6. The apparatus of claim 5, wherein the impeder sear includes a cam-shaped surface and the release interacts with the cam-shaped surface of the impeder sear to disengage the impeder sear from the member.

7. The apparatus of claim 6, wherein the cam-shaped surface of the impeder sear includes by an edge that defines an opening and the release includes a pin disposed within the opening and interacting with the edge to lift the impeder sear out of engagement with the member.

8. The apparatus of claim 5, wherein the sear movement retarder includes a piston assembly coupled to the impeder sear and having a piston displaced by the impeder sear during engagement between the impeder sear and the member.

9. The apparatus of claim 5, wherein the reset includes a reset sear and the sear movement retarder includes a piston assembly coupled to the impeder sear and the reset sear.

10. The apparatus of claim 9, wherein the piston assembly includes first and second pistons in fluid communication with one another, the first piston assembly being coupled to the impeder sear and the second piston assembly being coupled to the reset sear, and further wherein the reset sear engages the member during the third portion of the reciprocating cycle, is displaced by the member, and positions the impeder sear for engagement with the member during the first portion of the reciprocating cycle.

11. The apparatus of claim 5, wherein the sear movement retarder is resistive to compressive forces.

12. The apparatus of claim 11, wherein the sear movement retarder is additionally resistive to tensile forces.

13. The apparatus of claim 11, wherein the sear movement retarder includes a piston disposed with a housing, the housing being at least partially filled with a fluid medium.

14. The apparatus of claim 5, wherein the sear movement retarder includes an adjuster controlling the rate by which displacement of the member is impeded.

15. An ammunition feed mechanism for an automatic or semiautomatic weapon, including a chamber having a projectile entrance that cyclically open and closes, comprising:

a magazine having an exit, a ramped bottom which directs projectiles to the exit, and a central hub extending from the ramped bottom for supporting an ammunition carrier;

an ammunition carrier having a plurality of curved projections which define a plurality of spaces, each of which receives a projectile of ammunition; and an ammunition carrier advancing mechanism that actuates the ammunition carrier to positively force one projectile out of the exit each time the projectile entrance is open.

16. The ammunition feed mechanism of claim 15, where the ammunition carrier includes a wheel having a hub coupled to the ammunition carrier advancing mechanism, the projections radiate from the hub, and the projections are curved from a proximate end of each projection to a distal end of each projection.

17. The ammunition feed mechanism of claim 15, wherein the projections curve away from a direction of movement of the ammunition carrier.

18. The ammunition feed mechanism of claim 15, wherein the ammunition carrier advancing mechanism includes a spring that releases stored energy to move the ammunition carrier.

19. The ammunition feed mechanism of claim 18, wherein the ammunition carrier advancing mechanism includes a crank for storing energy in the spring when the crank is moved in a first direction and at least one anti-reversing roller coupled to the crank and engaging the magazine to help prevent the crank form moving in a second direction so that energy stored in the spring is used to move the ammunition carrier.

20. A gun, comprising:

a chamber having a projectile entrance;

a cyclically reciprocating member used in firing projectiles from the gun;

an ammunition feed mechanism including a magazine having an exit mounted adjacent the projectile entrance of the chamber and an ammunition carrier having a plurality of spaces each of which receives one of a plurality of projectiles positioned randomly in the magazine, the projectile carrier positively feeding one projectile into the chamber via the exit and projectile entrance at a same point during each reciprocating cycle of the member; and a retarder including an impeder engaged with the member during a first portion of the reciprocating cycle of the member, the impeder resisting displacement of the member during the first portion of the reciprocating cycle of the member, and disengaged from the member during a second portion of the reciprocating cycle of the member.

21. The gun of claim 20, wherein the first portion of the reciprocating cycle of the member is prior to firing one of the projectiles from the gun.

22. The gun of claim 20, wherein at least a part of the second portion of the reciprocating cycle of the member is after firing one of the projectiles from the gun.

23. The gun of claim 20, further comprising means for selecting a rate of fire of the gun.

24. The gun of claim 23, wherein the selecting means includes a mode selector switch positionable in one of a plurality of positions.

25. The gun of claim 24, wherein the positions include a locked position and an automatic firing position.

26. The gun of claim 25, wherein the positions further include a semi-automatic firing position.

27. The gun of claim 24, wherein the mode selector switch includes a pin having one or more surfaces for interacting with a firing mechanism of the gun in one or more of the mode selector switch positions to control displacement of the firing mechanism.

28. The gun of claim 27, wherein the firing mechanism includes a trigger.

29. The gun of claim 24, wherein the selecting means also includes means for releasably securing the selector switch in each mode selector switch position.

30. The gun of claim 29, wherein the selecting means includes a plurality of recessed portions formed in a body of the selector switch and a detent disposable in one of the recessed portions in each mode selector switch position.

31. An ammunition feed mechanism for an automatic or semiautomatic weapon, including a chamber having a projectile entrance that cyclically opens and closes, comprising:

a magazine having an exit, a spiral ramped bottom which directs projectiles to the exit, and a central hub extending from the ramped bottom for supporting an ammunition carrier;

an ammunition carrier having a plurality of spaces, each of which receives a projectile of ammunition; and an ammunition carrier advancing mechanism that actuates the ammunition carrier to positively force one projectile out of the exit each time the projectile entrance is open.

32. The ammunition feed mechanism of claim 31, wherein the ammunition carrier advancing mechanism includes a motor.

33. The ammunition feed mechanism of claim 31, wherein the exit of the magazine is located at a bottom of the magazine and the magazine is mounted to the apparatus so that ammunition in the magazine is gravity fed toward the bottom of the magazine during operation of the apparatus.

* * * * *